US009815291B2

(12) United States Patent
Agarwal

(10) Patent No.: US 9,815,291 B2
(45) Date of Patent: Nov. 14, 2017

(54) REPLACEABLE INTEGRATED PRINTHEAD CARTRIDGE

(71) Applicant: Hewlett-Packard Development Company, L.P., Houston, TX (US)

(72) Inventor: Arun K. Agarwal, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 15/307,304

(22) PCT Filed: Sep. 24, 2014

(86) PCT No.: PCT/US2014/057254
§ 371 (c)(1),
(2) Date: Oct. 27, 2016

(87) PCT Pub. No.: WO2016/048305
PCT Pub. Date: Mar. 31, 2016

(65) Prior Publication Data
US 2017/0050443 A1 Feb. 23, 2017

(51) Int. Cl.
*B41J 2/175* (2006.01)
*B41J 2/145* (2006.01)

(52) U.S. Cl.
CPC ..... *B41J 2/17553* (2013.01); *B41J 2/145* (2013.01); *B41J 2/175* (2013.01); *B41J 2/17513* (2013.01)

(58) Field of Classification Search
CPC .... B41J 2/17553; B41J 2/17513; B41J 2/175; B41J 2/17526; B41J 2/14072; B41J 2/16585; B41J 2/16588; B41J 2/2146; B41J 2/515; B41J 2/145; B41J 2/15; B41J 2/155; B41J 2002/20; B41J 2002/21; B41J 3/54; B41J 3/60; B41J 3/543; B41J 3/17503; B41J 3/2103
See application file for complete search history.

(56) References Cited

U.S. PATENT DOCUMENTS

| | | | | |
|---|---|---|---|---|
| 5,506,611 | A * | 4/1996 | Ujita | B41J 2/17503 347/19 |
| 6,176,572 | B1 | 1/2001 | Kato et al. | |
| 8,517,502 | B2 | 8/2013 | Mizes et al. | |
| 2009/0128600 | A1 | 5/2009 | Nagata et al. | |
| 2012/0242726 | A1 | 9/2012 | Mou et al. | |
| 2013/0271534 | A1 | 10/2013 | Boyd et al. | |
| 2014/0028748 | A1 | 1/2014 | Hudd et al. | |

FOREIGN PATENT DOCUMENTS

| | | |
|---|---|---|
| JP | 2002-036584 | 2/2002 |
| WO | WO-2013175024 | 11/2013 |
| WO | WO-2014003727 | 1/2014 |

OTHER PUBLICATIONS

Buskirk, William A., Production Digital Fabrication System Using the Dimatix Q-class Printhead; ImTech, Inc. Jan. 1, 2010; pp. 324-328 http://www.ingentaconnect.com/content/ist/nipdf/2010/00002010/00000001/art00086.
PCT International Search Report, Jun. 10, 2015, PCT Patent Application No. PCT/US2014/057254, Filed Sep. 24, 2014.

* cited by examiner

*Primary Examiner* — Juanita D Jackson
(74) *Attorney, Agent, or Firm* — HP Inc. Patent Department

(57) ABSTRACT

A replaceable integrated printhead cartridge is provided that comprises a liquid reservoir and a linear nozzle array being disposed in a bottom and extending perpendicular to a longitudinal axis.

15 Claims, 2 Drawing Sheets

REPLACEABLE INTEGRATED PRINTHEAD CARTRIDGE

CLAIM FOR PRIORITY

The present application is a national stage filing under 35 U.S.C. §371 of PCT application number PCT/US2014/057254, having an international filing date of Sep. 24, 2014, the disclosure of which is hereby incorporated by reference in its entirety.

BACKGROUND

Some liquid ejection devices, such as printers, use replaceable liquid supplies to provide and replenish liquid. These replaceable liquid supplies can be provided with integrated printhead circuitry so that when replacing the supply also new printhead circuitry is provided.

BRIEF DESCRIPTION OF THE DRAWINGS

For the purpose of illustration, certain examples constructed in accordance with this disclosure will now be described with reference to the accompanying drawings, in which.

DETAILED DESCRIPTION

In the following detailed description, reference is made to the accompanying drawings. The examples in the description and drawings should be considered illustrative and are not intended as limiting to the specific example or element described. Multiple examples can be derived from the following description and drawings through modification, combination or variation of the different elements.

Figure 1:
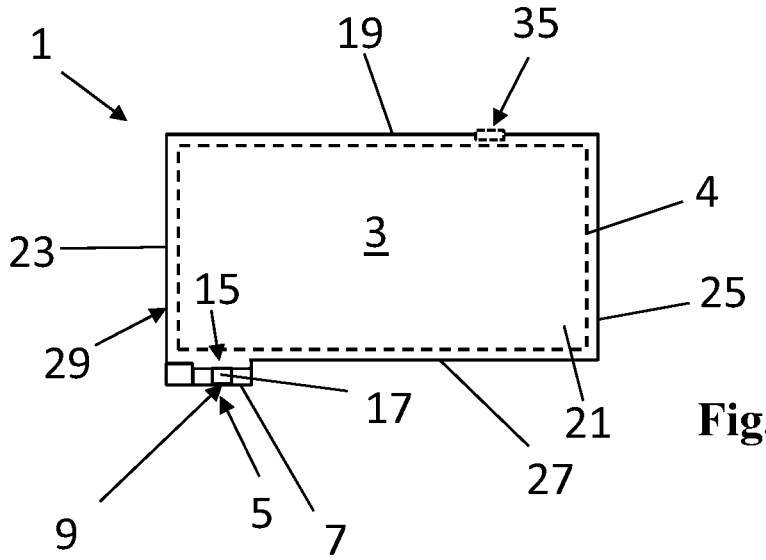
FIG. 1 illustrates an example of a replaceable integrated printhead cartridge in a diagrammatic cross sectional side view.
Figure 2:
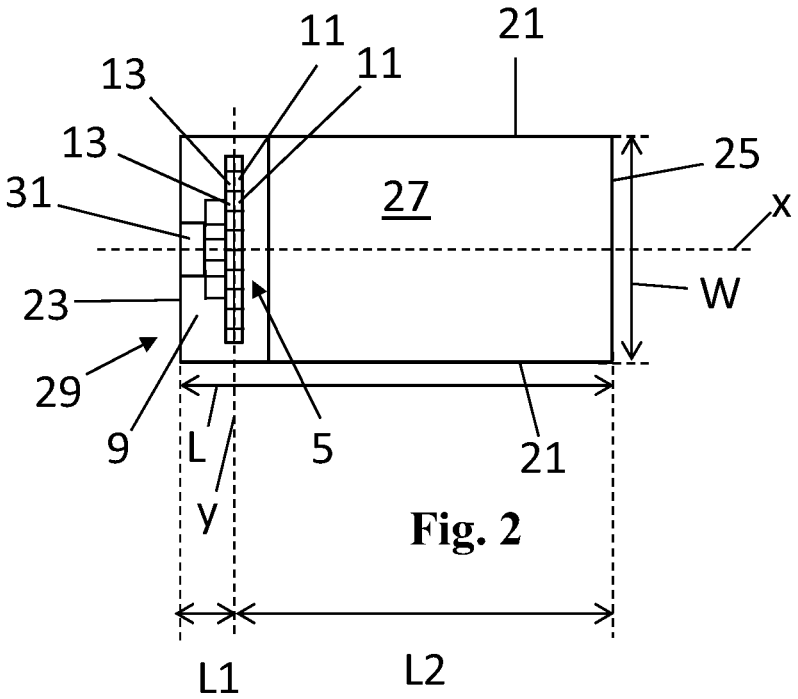
FIG. 2 illustrates the example replaceable integrated printhead cartridge of FIG. 1 in a diagrammatic cross sectional bottom view.

FIGS. 1 and 2 illustrate a replaceable integrated printhead cartridge 1 in a cross sectional side view and a bottom view, respectively. In this disclosure, a replaceable integrated printhead cartridge 1 may be referred to as cartridge 1. The cartridge 1 includes a reservoir 3 and printhead circuitry 5 attached to or embedded in the reservoir 3. The reservoir 3 includes rigid plastic or compound walls that are to enclose a volume of liquid. The reservoir 3 contains liquids such as inks, three-dimensional printing liquids (agents, adhesives, inhibitors, etc.), pharmaceutical liquids, or laboratory liquids, for example for usage in two-dimensional printing, three-dimensional printing, digital titration or laboratory applications, respectively. The printhead circuitry 5 is arranged for high precision dispensing. The circuitry 5 is disposed near a front wall 23 of the reservoir 3. In the illustrated example, the circuitry 5 is disposed on a head surface 7 of the reservoir 3. The head surface 7 is the part of a bottom 27 of the reservoir 3 wherein nozzles 11 are disposed. In an example, the head surface 7 protrudes with respect to the rest of the bottom 27. The circuitry 5 includes at least one linear array 9 of said nozzles 11. In one example the linear nozzle array 9 can be defined as one or multiple adjacent lines of nozzles that are fed by one feed slot. In one example the resolution of the nozzle array 9 is at least 300, 600, or at least 900 dots per inch.

In this disclosure, the linear nozzle array 9 extends perpendicular to a longitudinal axis x of the cartridge. In an example, the nozzle array 9 spans most of the width W of the cartridge 1, for example more than 50% of the width W, whereby most of the volume of the reservoir 3 extends towards the rear, away from the nozzle array 9. This allows for side-by-side stacking of multiple cartridges 1, to form a page wide print bar, while maintaining a relatively small rectangular print area, wherein the rectangular print area can be defined as the smallest rectangular area that spans all nozzle arrays 9 of all stacked cartridges that form one print bar.

In an example, the longitudinal axis x is an axis of symmetry of a general outer contour of the reservoir 3, as seen from a bottom or top view, and extends through a middle of the reservoir 3, between side walls 21. This example refers to a "general" outer contour because certain smaller features such as circuitry, mechanical keys or latch features or imprints on the cartridge 1 can make the cartridge 1 asymmetric with respect to the longitudinal axis x but need not be taken into account. In the illustrated example, the side walls 21 are approximately parallel to the longitudinal axis x so that the nozzle array 9 is perpendicular to the side walls 21. In a further example, a front wall 23 is approximately perpendicular to the longitudinal axis x so that the nozzle array 9 is also approximately parallel to the front wall 23. In other examples the front wall may be at least partly curved or pointy, and the side walls 21 need not be parallel to each other. Also non-symmetrical reservoir shapes are included in this disclosure. Generally, with longitudinal axis x it is intended to make clear that the shape of reservoir 3 protrudes over the longitudinal axis x towards the rear end of the cartridge 1, perpendicularly away from the nozzle array 9, so that in operation, a length L of the cartridge 1 extends generally parallel to a media advance direction.

The circuitry 5 includes an array of actuators 13. The actuators 13 can be positioned in or near firing chambers near the nozzles 11 to fire the liquid through the nozzles 11. Suitable actuators 13 include thermal resistors, piezo resistors and micro electro-mechanical system (MEMS) devices such as micro-pumps. The printhead circuitry 5 is integral to the reservoir 3. As such, the printhead circuitry 5 may be attached to or embedded to the reservoir 3. In one example, the printhead circuitry 5 may be attached to or embedded in a flexible substrate such as tape that is attached to the reservoir 3. In one example, the printhead circuitry 5 may be attached to or embedded in a rigid substrate such as a printed circuit board or any rigid compound that is attached to or embedded in the reservoir 3.

In an example, the reservoir 3 is completely or partly filled with print liquid such as ink or 3D print agent. The reservoir 3 is to supply the liquid to the printhead circuitry 5 until the reservoir 3 is substantially completely exhausted. The reservoir 3 includes an output 15 that is open to the nozzle array 9 to supply liquid from an inner volume of the reservoir 3 to the nozzles 11. At least one fluid feed slot 17 is to guide the fluid from the output 15 to respective firing chambers of the nozzles 9. A backpressure regulator 4 may be disposed in the reservoir 3 to hold liquid in the reservoir and/or prevent the liquid from leaking or dripping out of the nozzles 9 between print operations. A suitable example backpressure regulator is a capillary member. Such capillary member can be a suitable foam or filter-like structure. Other backpressure regulators 4 include inflatable bags or flexible walls combined with spring or bias members that adjust an inner pressure of the reservoir 3 by adjusting the inner volume. Other backpressure regulators 4 may include air pumps. In addition to the backpressure regulator 4, a suitable air interface 35 such as a vent hole may be provided in at least one of the reservoir walls to allow air to flow in (or out) and thereby suitably adapt the backpressure. The air interface 35 may provide for active or passive backpressure control during printing, internal vaporization, changes in (ambient) temperature or (ambient pressure). Herein, active backpressure control refers to an air interface 35 that is connected to a pump or the like and passive backpressure control refers to a vent hole or bubbler that is directly open to ambient air. Other passive air interfaces may include a labyrinth air channel to allow air to travel through the interface while preventing vapor to travel through the interface.

In an example, the reservoir 3 and its integral printhead circuitry 5 are intended for replacement after the reservoir 3 is at least substantially exhausted. For example, the reservoir 3 does not include predisposed liquid inputs for connection to and regulation of a further liquid supply. For example a top wall 19, side walls 21, front wall 23, rear wall 25, and a bottom 27 of the reservoir 3 are closed, except for said at least one air interface 35 and at least one liquid output 15. In such an example, other than the output 15 or air interface 35, the cartridge 1 is substantially liquid tight, to be disposed of after exhaustion. "Substantially" liquid tight does not necessarily mean "completely" liquid tight, because it can happen that small amounts of vapor or liquid exit or enter the reservoir 3, for example through the output 15, air interface 35 or through the walls, for example unintentionally. Before installing the cartridge 1 in a printer, the nozzles 9 and air interface 35 may be sealed by at least one sealing structure such as a label, film or cap. Such sealing structure can be disposed of manually before installing the cartridge 1, or is opened by installing the cartridge 1, for example pierced.

The nozzle array 9 and the actuators 13 are arranged in the bottom 27, adjacent to the front wall 23. In the illustrated example the reservoir walls 21, 23, 25, 27 are at right angles with respect to each other so that the nozzle array 9 extends perpendicular to the side walls 21 and parallel to the front wall 23. The printhead circuitry 5 includes an electrical circuit interface 31 to connect the actuators 13 to a printer circuit when the cartridge 1 is installed in a printer, to allow the printer circuit to drive the actuators 13. In the illustrated diagrammatic example, the electrical circuit interface 31 is disposed directly adjacent the front wall 23 and on the bottom 27, between the nozzle array 9 and the front wall 23. In another example the electrical circuit interface 31 is disposed on the front wall 23, adjacent the bottom 23.

The reservoir 3 has a length L and a width W, wherein the length dimension is larger than the width dimension. The length L is measured along a longitudinal axis x of the reservoir 3. The longitudinal axis x extends perpendicular to a transverse axis y along which the nozzle array 9 is arranged. In an example, the ratio length L versus width W of the reservoir 3 is at least approximately 3:2, or at least approximately 2:1, or at least approximately 3:1, or at least approximately 4:1. In one example, the reservoir 3 is longitudinally shaped and for the most part extends from right above the nozzle array 9 towards the rear. For example, the total length L of the cartridge 1, as measured over the longitudinal axis x, is the sum of a first length L1, from the nozzle array 9 up to a rear most point of the rear wall 25, and a second length L2, from a front most point of the front wall 23 up to said nozzle array 9, wherein the ratio of the first length L1 versus the second length L2 is at least approximately 4:1, at least 5:1, at least 6:1 or at least 10:1, respectively. When the printhead circuitry 5 includes multiple nozzle arrays 9, said first and second lengths L1, L2 can be determined by a rear most nozzle array 9 that extends closest to the rear wall 25. Hereby it may be understood that when designing the cartridge 1 the length of the cartridge 1 can be increased by displacing the rear wall 25 away from the nozzle array 9 while the nozzle array 9 is disposed close the front wall 23. This allows multiple integrated printhead cartridges 1 to be stacked horizontally to form a static page wide print bar, in a space efficient manner, as best explained with reference to FIGS. 3 and 4.

Figure 3:
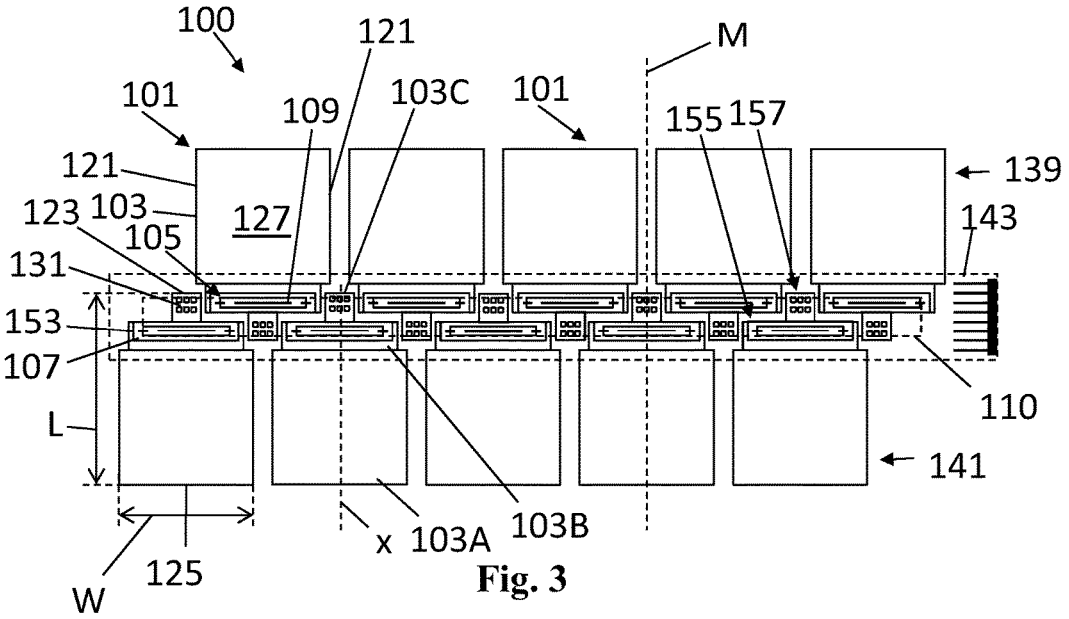
FIG. 3 illustrates an example of multiple replaceable integrated printhead cartridges that form a print bar, and an example printer circuit interface, in a diagrammatic bottom view.
Figure 4:
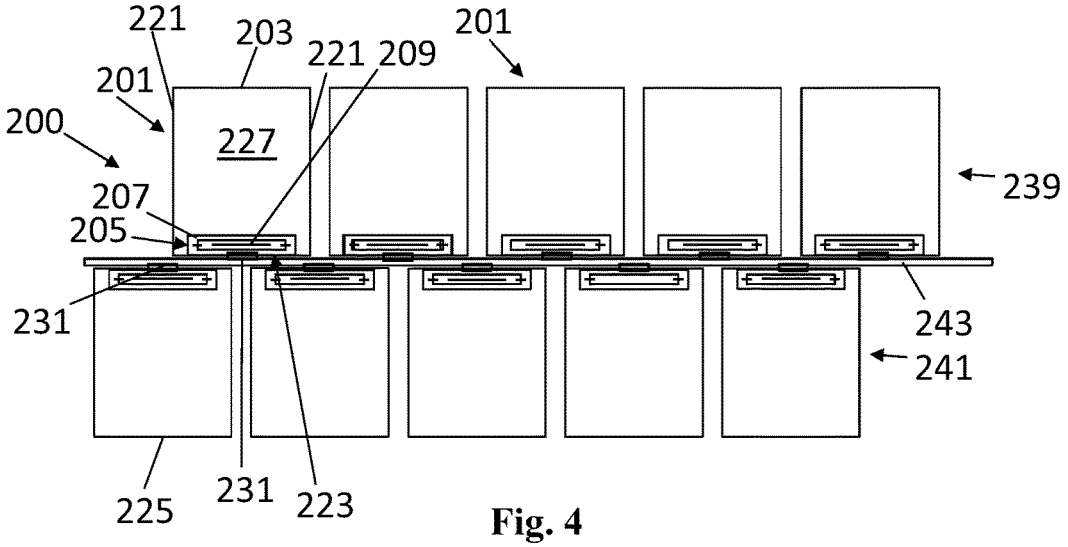
FIG. 4 illustrates another example of multiple replaceable integrated printhead cartridges that form a print bar, and another example printer circuit assembly, in a diagrammatic bottom view.

FIGS. 3 and 4 illustrate a diagram of examples of integrated printhead cartridges 101, 201 that are stacked side-by-side to form a print bar 100, 200, having a print area 110. In each drawing, each of the illustrated cartridges 101, 201 has the same dimensions and features. For clarity, the reference numbers are applied to only one cartridge 101, 201 in the illustration but apply equally to other cartridges 101, 201.

In FIG. 3, the printhead circuitry 105 is disposed on a bottom 127 of the reservoir 103, near a front wall 123 of the reservoir 103. The printhead circuitry 105 includes a nozzle array 109 and an electrical circuit interface 131. The reservoir 103 has a maximum length L, which is a shortest distance between a rear wall 125 and a front wall 123 furthest away from the rear wall 125, and a maximum width W, which is a shortest distance between the side walls 121 that are furthest away from each other, wherein the maximum length L is larger than the maximum width W. For example the length:width ratio is at least 2:1, or at least 3:1, or at least 4:1. The nozzle array 109 extends perpendicular to the longitudinal axis x of the reservoir 3. In the illustrated example the nozzle array 109 extends perpendicular to the front wall 123 and rear wall 125 and parallel to the side walls 121. The longitudinal shape of the reservoir 103 allows for storing a relatively large amount of liquid in the reservoir 103 while the reservoir has a relatively low profile for relatively flat print systems and a relatively narrow width for side-by-side stacking. The circuitry 105 is disposed adjacent the front wall 123 while the rear wall 125 can be designed at a suitable distance L from the front for storing more ink without affecting height or side-by-side stacking. The transverse orientation of the nozzle array 109 facilitates that the nozzle array 109 occupies only a small portion of the total length L of the cartridge 101. For example at least 75%, at least 80%, at least 85% or at least 90% of the length of the reservoir 103 extends away from the circuitry 105, that is, not above the circuitry 105. In other words, the total length L of the cartridge 101, as measured over the longitudinal axis x, can be the sum of a first length, from the nozzle array 109 up to a rear most point of the rear wall 125, and a second length, from a front most point of the front wall 123 up to said nozzle array 109, wherein the ratio of the first length versus the second length is at least approximately 4:1, at least 5:1, at least 6:1 or at least 1:10. The end point of the first and second length L1, L2 is on a straight line that can be drawn over the centers of the nozzles, although it is mentioned that the nozzles are so small as compared to the lengths L1, L2 that in practice the point on the nozzle array 109 can be freely chosen without affecting the mentioned ratio L1:L2. When the printhead circuitry 105 includes multiple parallel nozzle arrays 109, an end point of the first and second length L1, L2 can be determined by a rear most nozzle array 109 that extends closest to the rear wall 125.

In the illustration, two opposite cartridge arrays 139, 141 are installed, wherein the front walls 123 of the cartridges 101 of each array 139, 141 face opposite directions, and the nozzle arrays 109 are parallel to each other and perpendicular to a media advance direction. Cartridges 101 of the first cartridge array 139 are displaced sideways with respect to the opposite cartridge 101 of the second cartridge array 141 so that the nozzle arrays 109 of cartridges 101 of the first cartridge array 139 span the space between two subsequent nozzle arrays 109 of the second cartridge array 141 to form a page wide array. For example a plane M that is parallel to side walls 121 of the reservoir 103 and extends through a middle of the cartridge 101 may extend through an empty space between side walls 121 of two opposite cartridges 101. There may be some overlap between opposite nozzle arrays 109 to ensure page wide coverage.

An electrical circuit interface 131 is disposed adjacent the front wall 123 and adjacent the nozzle arrays 109, in the bottom 127. The electrical circuit interfaces 131 of the installed cartridges 101 extend in one plane. The printer circuit interface 143 is planar to connect to all electrical circuit interfaces 131. The printer circuit interface circuitry extends in one plane. For example, the printer circuit interface 143 includes a rigid, planar substrate with embedded or attached circuitry. The printer circuit interface 143 may be a printed circuit board. In the illustrated example, the electrical circuit interface 131 extends in a plane that is approximately parallel and/or flush to a head surface 107 in which the nozzles 111 are arranged. The print circuit interface 143 can be relatively flat and also generally parallel to the head surface 107 in an installed condition of the cartridge 101. For example, in an installed condition, at least 75%, at least 80%, at least 85% or at least 90% of the length of the reservoir 103 extends away from the printer circuit interface 143, that is, not above the printer circuit interface 143.

The linear nozzle array 109 spans at least half a maximum width W of the cartridge 101. This allows for all the nozzle arrays 109 to span an entire page width without gaps between nozzle arrays 109.

The nozzle array 109, actuator array, and the electrical circuit interface 131 can be embedded in and/or attached to a single substrate. The substrate may be attached to or embedded in the reservoir bottom 125 and/or the front wall 123. In an example, the substrate is a flexible tape. In another example, the substrate is a rigid compound.

The illustrated cartridge 101 has a front portion that is narrower than a rear portion. A first, main reservoir body 103A that extends from behind the nozzle array 109 up to the rear wall 125 has the largest width W. A second reservoir front section 103B has a smaller width than the first, main reservoir body 103A and supports the nozzle array 109 at the bottom 127. The second reservoir section 103B protrudes from the main reservoir body 103A, providing for a step in the side walls 121 and the front wall 123. A third reservoir front section 103C has a smaller width than the second front section 103B and protrudes out of the second front section 103B thereby providing for another step in the side walls 121 and front wall 123. In one example the sections 103A, 103B, 103C have one planar bottom 127. In another example, the bottoms of sections have steps between each other. In the illustrated example, the bottom of the third reservoir front section 103C supports the electrical circuit interface 131. As illustrated, the second reservoir front section 103B extends next to a third reservoir front section 103C of an opposite cartridge 101. The step between the main reservoir body 103A and the second reservoir front section 103B clears space for an opposite third reservoir front section 103C of an opposite cartridge 101. As illustrated, the nozzle arrays 109 of opposite cartridges 101 near to each other. Hence a relatively small print area 110 can be obtained. As illustrated, parts of the electrical circuit interfaces 131 of opposite cartridges 101 of opposite arrays 139, 141 extend next to each other. Hence a relatively small print circuit interface 143 can be used.

In other examples that are not illustrated the side walls may converge to the front in a more continuous manner, for example diverging in a conical or curved shape, rather than in a stepped manner (combinations are also possible). The narrower front portions 103B, 103C that converge from rear to front in a stepped or in a continuous manner, allow for some overlap between side walls 121 of side-by-side stacked cartridges 101, and hence, a relatively small rectangular print area 110 and/or printer circuit interface 143.

FIG. 4 illustrates another example of a print bar 200 composed of multiple replaceable integrated printhead cartridges 201. Similar to FIG. 3, an electrical circuit interface 231 is disposed adjacent to the front wall 223 and nozzle array 209. In the example of FIG. 4, the electrical circuit interface 231 is attached to or embedded in the front wall 223. The electrical circuit interface 231 may extend near a bottom 227 of the cartridge 201. The electrical circuit interfaces 231 of one cartridge array 239 or 241 extend in a common vertical plane. The opposite electrical circuit interfaces 231 of the opposite cartridge arrays 239, 241 extend in parallel planes. A corresponding printer circuit interface 243 includes a planar, vertically arranged substrate having interface circuitry on both sides, to connect to both opposite arrays of electrical circuit interfaces 231 of the opposite cartridge arrays 239, 241. For example, the printer circuit interface 243 consists of a single rectangular printed circuit board.

In the example of FIG. 4 the entire bottom 227 and/or top of the reservoir 203 is generally rectangular shaped. The walls may be generally flat and extend at right angles with respect to each other. The cartridge 201 may have a box shape, generally. In one example the printhead surface 207 and/or printhead circuitry 205 may protrude out of the bottom 227, for example while the rest of the cartridge 201 is generally box shaped.

In one example the reservoirs 103, 203 of FIGS. 3 and 4 contain one color ink to form a page wide nozzle array for printing in one color. In a further example, a corresponding printer has only one such print bar and the color is black. In a further example the head circuitry 105, 205 of each cartridge 101, 201 has only one linear nozzle array 109, 209 for printing said one color. In a further example the nozzle array 109, 209 include one nozzle row. In another example the nozzle array 109, 209 includes two adjacent nozzle rows wherein one feed slot feeds the two nozzle rows, one nozzle row near each side of the feed slot.

In other examples, the reservoirs may contain multiple color inks and multiple corresponding nozzle arrays. The reservoirs may have internal walls to separate different color chambers wherein each chamber is connected to a different nozzle array. In again other examples a printer contains multiple print bars, in an installed condition of the cartridges 101, 201, wherein each print bar may be arranged to print in one or two specific colors.

In the examples illustrated in FIGS. 3 and 4, each cartridge array 139, 239, 141, 241 consists of five cartridges 101, 201 so that the print bar 100, 200 is composed of ten cartridges 101, 201. For example, the print bar is to print on A4, letter or similarly sized pages. The cartridges 101, 201 may be equipped with nozzle arrays 109, 209 having a length of at least approximately 2.2 centimeters (⅞ inch). Hence, a print zone width is at least approximately 22 centimeter, or at least approximately 21 centimeters with some overlap of nozzle arrays, or at least approximately 20 centimeters with some overlap of nozzle arrays. In a further example each cartridge reservoir 103, 203 contains at least approximately 50 cubic centimeters of inner-volume, which amounts to a total volume of at least approximately 500 cubic centimeters for a print bar composed of ten such cartridges 101, 201. Depending on the contents of the printed pages, or on the standard chosen to measure page yield, a page yield may be at least approximately 20.000 pages per A4, letter or similar size print bar. Similarly the print bar may be composed of more or larger cartridges 101, 201 that are to print on larger size media, such as for example at least approximately A3 size paper. In a further example the print bar may have a print speed of at least approximately 40 A4 pages per minute in accordance with internationally accepted standards such as ISO/IEC 24734.

The disclosed cartridge 1, 101, 201 can be replaced individually without a need to replace the entire print bar. Each cartridge 1, 101, 201 is to be replaced after liquid exhaustion. Thereby the individual cartridge printheads are renewed when replacing the cartridge. Hence, the print bar 100, 200 can be partly, or if necessary completely, disposed. The nozzle arrays 102, 209 can be arranged near the front wall and perpendicular to the longitudinal axis so that small rectangular print areas can be obtained per print bar. The electrical circuit interfaces 131, 231 of a cartridge array 139, 141, 239, 241 can be arranged in a single plane to allow for a relatively simple and cheap printer circuit interface 143, 243.

The invention claimed is:

1. A replaceable integrated printhead cartridge to form a module of a page wide array print bar, comprising a liquid reservoir having an output and a length dimension that is larger than a width dimension, the length dimension being measured over a longitudinal axis of the reservoir; and a linear nozzle array being disposed in a bottom and near a front of the reservoir, extending perpendicular to the longitudinal axis.

2. The replaceable integrated printhead cartridge of claim 1 wherein the nozzle array spans at least half a maximum width of the reservoir.

3. The replaceable integrated printhead cartridge of claim 1 wherein a total length of the reservoir is the sum of a first length, from the nozzle array up to a rear most point of a rear wall, and a second length, from a front most point of the front wall up to said nozzle array; and the ratio of the first length versus the second length is at least 5:1.

4. The replaceable integrated printhead cartridge of claim 1 wherein the reservoir includes a capillary member for holding liquid and regulating backpressure.

5. The replaceable integrated printhead cartridge of claim 1 comprising an actuator array to fire liquid through the nozzle array; and an electrical circuit interface connected to the actuator array, to connect to a printer circuit to signal the actuator array, wherein the electrical circuit interface extends at a front and bottom of the reservoir, adjacent the nozzle array.

6. The replaceable integrated printhead cartridge of claim 5 wherein the nozzle array and the electrical circuit interface extend in or over the same substrate.

7. The replaceable integrated printhead cartridge of claim 5 wherein the bottom comprises a head surface, wherein the electrical circuit interface extends in a plane that is parallel to the head surface.

8. Multiple replaceable integrated printhead cartridges of claim 7 that are stackable in a row side-by-side, the electrical circuits are disposed adjacent the front of the cartridges so that the neighboring electrical circuit interfaces at least partly overlap.

9. The replaceable integrated printhead cartridge of claim 5 wherein the bottom comprises a head surface, wherein the electrical circuit interface is embedded in or attached to a front wall, in a plane that is perpendicular to a head surface.

10. Multiple replaceable integrated printhead cartridges of claim 9 that are stackable in a row side-by-side, to form at least part of a page wide array print bar, by arranging cartridges in at least two parallel arrays, wherein within each array the nozzle arrays are in line and between the arrays the nozzle arrays are in parallel; and between the arrays the cartridges face opposite directions;

so that the electrical circuit interfaces are connectable to a single printer circuit plane perpendicular to the head surface.

11. The replaceable integrated printhead cartridge of claim 5 wherein a front reservoir portion above the nozzle array or electrical circuit interface is narrower than a rear reservoir portion away from the nozzle array.

12. The replaceable integrated printhead cartridge of claim 1 comprising only one color ink.

13. The replaceable integrated printhead cartridge of claim 1 comprising a single nozzle array.

14. A replaceable integrated printhead cartridge, comprising head circuitry including a nozzle array, an actuator array and an electrical circuit interface to connect to a printer circuit; and a longitudinally shaped reservoir, to supply ink to the nozzle array; wherein the nozzle array extends parallel to a front wall of the reservoir;

a total length of the reservoir is the sum of a first length, from the nozzle array up to a rear most point of a rear wall, and a second length, from a front most point of the front wall up to said nozzle array;

the ratio of the first length versus the second length is at least 5:1; and the nozzle array spans at least half of the reservoir width.

15. The replaceable integrated printhead circuitry cartridge of claim 14 wherein the electrical circuit interface is attached or embedded in a bottom.

* * * * *